US011346178B2

(12) United States Patent
Takahashi et al.

(10) Patent No.: US 11,346,178 B2
(45) Date of Patent: May 31, 2022

(54) DEGRADABLE DOWNHOLE PLUG

(71) Applicant: Kureha Corporation, Tokyo (JP)

(72) Inventors: Shinya Takahashi, Tokyo (JP); Aki Shitsukawa, Tokyo (JP)

(73) Assignee: Kureha Corporation, Toko (JP)

( * ) Notice: Subject to any disclaimer, the term of this patent is extended or adjusted under 35 U.S.C. 154(b) by 0 days.

(21) Appl. No.: 16/960,240

(22) PCT Filed: Dec. 26, 2018

(86) PCT No.: PCT/JP2018/047889
§ 371 (c)(1),
(2) Date: Jul. 6, 2020

(87) PCT Pub. No.: WO2019/146359
PCT Pub. Date: Aug. 1, 2019

(65) Prior Publication Data

US 2021/0062609 A1 Mar. 4, 2021

(30) Foreign Application Priority Data

Jan. 29, 2018 (JP) ..... JP2018-012943

(51) Int. Cl.
*E21B 33/129* (2006.01)

(52) U.S. Cl.
CPC ..... *E21B 33/129* (2013.01)

(58) Field of Classification Search
CPC ... E21B 220/08; E21B 2200/08; E21B 33/129
See application file for complete search history.

(56) References Cited

U.S. PATENT DOCUMENTS 8,567,494 B2 * 10/2013 Rytlewski ..... C09K 8/50 166/250.01
2002/0029880 A1 3/2002 Slup et al.
(Continued)

FOREIGN PATENT DOCUMENTS

CN 103201453 A 7/2013
CN 104989317 A 10/2015
(Continued)

OTHER PUBLICATIONS

English translation of International Preliminary Report on Patentability and Written Opinion dated Aug. 13, 2020, in PCT/JP2018/047889 (Forms PCT/IB/338, PCT/IB/373, and PCT/SA/237).
(Continued)

*Primary Examiner* — Giovanna Wright
*Assistant Examiner* — Ronald R Runyan
(74) *Attorney, Agent, or Firm* — Birch, Stewart, Kolasch & Birch, LLP

(57) ABSTRACT

A downhole plug for well completion is provided, which rapidly degrades after hydraulic fracturing, so that the flow path is recovered in a short time. A downhole plug (10) is provided, which includes: a mandrel (1) made of a degradable material; and a plurality of peripheral members (2, 3, 4, 5, 6*a*, 6*b*, 8*a*, 8*b*) made of a degradable material and disposed on an outer peripheral surface of the mandrel (1), where at least one of the plurality of peripheral members (6*a*, 6*b*) includes: a hollow portion (64) through which a fluid flowing along an axial direction of the mandrel (1) can pass; or a groove in at least a portion of, a surface serving as an outer surface of the downhole plug (10), or a surface in contact with the mandrel (1).

15 Claims, 11 Drawing Sheets

(56) References Cited

U.S. PATENT DOCUMENTS

| | | | | |
|---|---|---|---|---|
| 2005/0263281 | A1 | 12/2005 | Lovell et al. | |
| 2007/0181224 | A1 | 8/2007 | Marya et al. | |
| 2008/0008562 | A1 | 1/2008 | Beckel et al. | |
| 2008/0053652 | A1 | 3/2008 | Corre et al. | |
| 2008/0066920 | A1 | 3/2008 | Allcorn et al. | |
| 2008/0066963 | A1 | 3/2008 | Sheiretov et al. | |
| 2008/0069301 | A1 | 3/2008 | Shampine et al. | |
| 2008/0069307 | A1 | 3/2008 | Shampine et al. | |
| 2008/0073077 | A1 | 3/2008 | Tunc et al. | |
| 2008/0105438 | A1 | 5/2008 | Jordan et al. | |
| 2008/0152080 | A1 | 6/2008 | Shampine et al. | |
| 2009/0151936 | A1 | 6/2009 | Greenaway | |
| 2009/0218105 | A1 | 9/2009 | Hill et al. | |
| 2009/0226340 | A1 | 9/2009 | Marya | |
| 2010/0018703 | A1 | 1/2010 | Lovell et al. | |
| 2010/0084132 | A1 | 4/2010 | Noya et al. | |
| 2010/0089571 | A1 | 4/2010 | Revellat et al. | |
| 2011/0048743 | A1 | 3/2011 | Stafford et al. | |
| 2011/0067889 | A1 | 3/2011 | Marya et al. | |
| 2011/0253393 | A1 | 10/2011 | Vaidya et al. | |
| 2012/0080189 | A1 | 4/2012 | Marya et al. | |
| 2013/0025878 | A1 | 1/2013 | Burgos et al. | |
| 2013/0327545 | A1 | 12/2013 | Marya et al. | |
| 2014/0224506 | A1* | 8/2014 | Xu | E21B 33/134 166/376 |
| 2014/0251641 | A1 | 9/2014 | Marya et al. | |
| 2014/0286810 | A1 | 9/2014 | Marya | |
| 2014/0363692 | A1 | 12/2014 | Marya et al. | |
| 2015/0101796 | A1 | 4/2015 | Davies et al. | |
| 2016/0160611 | A1 | 6/2016 | Zhang et al. | |
| 2017/0234103 | A1 | 8/2017 | Frazier | |
| 2017/0314341 | A1 | 11/2017 | Lovell et al. | |
| 2019/0002667 | A1 | 1/2019 | Kobayashi et al. | |
| 2019/0017333 | A1 | 1/2019 | Burgos et al. | |

FOREIGN PATENT DOCUMENTS

| | | | |
|---|---|---|---|
| CN | 106522869 | A | 3/2017 |
| CN | 107013181 | A | 8/2017 |
| CN | 206522118 | U | 9/2017 |
| WO | WO 2016/003759 | A1 | 1/2016 |
| WO | 2017/110610 | A1 | 6/2017 |

OTHER PUBLICATIONS

International Search Report of the International Searching Authority for PCT/JP2018/047889 dated Mar. 26, 2019.

English translation of International Search Report of the International Searching Authority for PCT/JP2018/047889 dated Mar. 26, 2019.

Office Action dated Sep. 3, 2021, Chinese Patent Application No. 201880080889.5.

Office Action dated Jul. 29, 2021, in Canadian Patent Application No. 3,087,148.

English translation of International Preliminary Report on Patentability and Written Opinion dated Aug. 13, 2020, in PCT/JP2018/047889 (Forms PCT/IB/338, PCT/IB/373, and PCT/ISA/237).

Canadian Office Action for Canadian Application No. 3,087,148, dated Mar. 22, 2022.

* cited by examiner

DEGRADABLE DOWNHOLE PLUG

TECHNICAL FIELD

The present invention relates to a degradable downhole plug used in a hydraulic fracturing method.

BACKGROUND ART

The hydraulic fracturing method is a method for stimulating a productive zone to generate perforations, cracks (fractures), or the like in the productive zone by a fluid pressure such as hydraulic pressure (hereinafter, sometimes simply referred to as "hydraulic pressure") and collect and recover hydrocarbon resources through the fractures or the like. A productive zone is a layer that produces hydrocarbon resources, which are petroleum such as shale oil, or natural gas such as shale gas, or the like. The hydraulic fracturing method generally drills a vertical hole, then bends the vertical hole to drill a horizontal hole in a subterranean formation several thousand meters underground. After that, a fluid such as a fracturing fluid is pumped into these wellbores under high pressure to cause cracks or the like in the underground productive zone due to hydraulic pressure. Then, the hydrocarbon resources are collected and recovered through the fractures or the like. Additionally, the term "wellbore" refers to a hole provided to form a well, and may also be referred to as a "downhole".

The following methods are typically employed to create cracks and perforations in an underground productive zone by hydraulic pressure by using a fluid pumped at high pressure. In other words, a predetermined section of a wellbore (downhole) drilled in a subterranean formation several thousand meters underground is partially plugged sequentially from the toe section of the wellbore, and a fluid is pumped at high pressure into the plugged section to produce cracks and perforations in the productive zone. Then, the next predetermined section (typically in front of the preceding section, i.e., a section closer to the ground surface) is plugged to produce cracks and perforations. Hereinafter, the process is repeated until the formation of cracks and perforations has been completed in all required sections.

A variety of downhole tools have been developed and used to plug a wellbore by being set in the wellbore. A downhole plug is known as one of these downhole tools. The downhole plug is set in the wellbore to plug a portion of the wellbore. The downhole plug, referred to as a frac plug, bridge plug or packer, or the like, includes at least one mandrel, and one or more members attached on the outer peripheral surface of the mandrel.

After the downhole plug is introduced into the wellbore, a predetermined member is extended in diameter and fixed to the wellbore by coming into contact with the inner wall of the wellbore, and a sealing member, which also constitutes a downhole plug, or the like seals between the inner wall of the wellbore and the downhole plug, thereby plugging the wellbore.

The members that constitute such a downhole plug are designed in various ways according to their functions, and for example, in Patent Document 1, a slip with holes drilled therein is disclosed for the purpose of having heat insulating properties to block heat from the inner wall of a wellbore. In addition, in Patent Document 2, a slip with a hollow interior is disclosed for the purpose of facilitating destruction by a drill.

On the other hand, the downhole plug is used to temporarily plug a wellbore depending on the construction method, and thus it is necessary to remove the downhole plug after use. Various degradable downhole plugs have been proposed to facilitate their removal. The degradable downhole plug has at least a portion of its constituent members formed of a degradable material that degrades depending on the well environment. Thus, the entire degradable downhole plug degrades or disintegrates after use, and as a result, the downhole plug can be easily removed (e.g., Patent Document 3). In such a degradable downhole plug, control of degradability is an issue, and for example, a bottom sub embedded with a degradation accelerator has been proposed in order to promote the degradation of materials with insufficient degradation rate (Patent Document 4).

CITATION LIST

Patent Document

Patent Document 1: US 2015/0,101,796 A1
Patent Document 2: US 2002/0,029,880 A1
Patent Document 3: US 2017/0,234,103 A1
Patent Document 4: US 2016/0,160,611 A1

SUMMARY OF INVENTION

Technical Problem

FIGS. 1, 2A, and 2B are reference drawings to illustrate a conventional downhole plug. FIG. 1 is a schematic view illustrating a portion of an axial cross section of a conventional downhole plug. FIGS. 2A and 2B are views where the downhole plug illustrated in FIG. 1 is set in a casing. FIG. 2A illustrates before hydraulic fracturing, and FIG. 2B illustrates after hydraulic fracturing. For convenience of explanation, in FIGS. 1, 2A, and 2B, the axial direction of the downhole plug is illustrated as the left-right direction in the drawing, but in actual use, the downhole plug may also be disposed such that the axial direction of the downhole plug is along the depth direction of the wellbore.

First, as illustrated in FIG. 1, the downhole plug 100 includes a mandrel 101, a sealing member 102, a retaining member 103 disposed adjacent to the sealing member 102 on one side of the sealing member 102, cones 104,105 disposed to sandwich the sealing member 102 and the retaining member 103, a pair of slips 106*a*, 106*b*, and a pair of ring members 107*a*, 107*b*. The ring member 107*a* is slidable in the axial direction of the mandrel 101 with respect to the mandrel 101, and the ring member 107*b* is fixed to the mandrel 101. The sealing member 102 in this embodiment is formed of an elastic material or a rubber material that deforms when a predetermined force is applied.

In the wellbore (not illustrated), the downhole plug 100 is set in a casing 200 disposed within the wellbore, as illustrated in FIG. 2A. When the downhole plug 100 is set in the casing 200, the mandrel 101 is moved in the axial direction indicated by the arrow P in the figure to reduce the distance between the pair of ring members 107*a*, 107*b* in the axial direction of the mandrel. This makes the slips 106*a*, 106*b* move outwardly orthogonal to the axial direction of the mandrel 101 along the incline of the cones 104, 105 and contact with the inner wall of the casing 200, so that the downhole plug 100 can be disposed in place in the wellbore. Also, as the mandrel 101 moves in the axial direction and the distance between the cone 104 and the retaining member 103 decreases, the sealing member 102 deforms and expands outwardly in the outer peripheral direction of the axis of the mandrel 101. Then, the sealing member 102 comes into contact with the casing 200, so that the space between the downhole plug 100 and the casing 200 is plugged. The wellbore is then plugged by placing a ball (not illustrated) in the axial hollow portion of the mandrel 101. Next, a fluid is pumped into the plugged section from the side of the cone 104 at high pressure, and hydraulic fracturing is performed to create cracks in the productive zone.

When the downhole plug is a degradable downhole plug formed of a degradable material that is degraded by the fluid in the well, the downhole plug is degraded from the part in contact with the fluid by exposure to the fluid in the well for a predetermined time. The downhole plug is removed by disintegration and dissolution, and the blocked flow path can be recovered.

However, the present inventors found that the degradation of the degradable downhole plug was delayed longer than expected, and the recovery of the flow path may be delayed.

The present invention was made in view of the above-described problems, and the purpose of the invention is to provide a plug for well completion that can quickly degrade after hydraulic fracturing to recover the flow path in a short time.

Solution to Problem

As a result of the intensive investigation, the present inventors found that the casing and the degradable downhole plug, and the members themselves constituting the degradable downhole plug were in close contact with each other, which causes the insufficient flow of the fluid in the well to the degradable downhole plug, resulting in the delay of degradation due to the small area of the degradable downhole plug exposed to the fluid. That is, as illustrated in FIG. 2B, after hydraulic fracturing, the slips 106*a*, 106*b* of the degradable downhole plug and the sealing member 102 come into contact with the casing 200. In addition, the cone 104 comes into contact with the sealing member 102 and the slip 106*a*. Further, the cone 105 comes into contact with the retaining member 103 and the slip 106*b*. It is found that the degradation of the degradable downhole plug after hydraulic fracturing is delayed because the surface exposed to the fluid flowing along the axial direction of the mandrel, i.e., the direction of arrow F1 or F2 in FIGS. 2A and 2B, is limited.

The present invention has been completed based on new findings found by the present inventors to solve the above problem, and the downhole plug according to the present invention includes: a mandrel made of a degradable material; and a peripheral member made of a degradable material and provided on an outer peripheral surface of the mandrel, where the peripheral member includes: a hollow portion through which a fluid flowing along an axial direction of the mandrel can pass; or a groove in at least a portion of, a surface serving as an outer surface of the downhole plug, or a surface in contact with the mandrel.

Advantageous Effects of Invention

According to the present invention, a degradable downhole plug with a flow path recovered in a short time after hydraulic fracturing can be provided.

BRIEF DESCRIPTION OF THE DRAWINGS

FIG. 2A illustrates before hydraulic fracturing, and FIG. 2B illustrates after hydraulic fracturing.

DESCRIPTION OF EMBODIMENTS

1. Downhole Plug

The downhole plug of the present invention includes a mandrel made of a degradable material, and a plurality of peripheral members made of a degradable material and disposed on an outer peripheral surface of the mandrel, where at least one of the plurality of peripheral members at least partially includes a hollow portion through which a fluid along an axial direction of the mandrel can pass, or a groove on the outer surface side of the downhole plug.

The above-described hollow portion is preferably provided in the peripheral member which obstructs the flow of the fluid in the axial direction of the mandrel in the conventional downhole plug after hydraulic fracturing. The above-described hollow portion in such a peripheral member allows the fluid to pass therethrough and promotes the degradation and removal of the degradable downhole plug. In addition, since the downhole plug of an embodiment of the present invention facilitates the passage of the fluid from the initial stage of degradation, it is preferable that the above hollow portion is connected to at least one opening in the above-described peripheral member on the surface in contact with the above-described flow, and the hollow portion is more preferably a through hole connected to two or more openings.

Moreover, the groove of the above peripheral member is a groove, on a surface located on the outer surface side of the above downhole plug, of the above peripheral member. In particular, it is preferable that the groove is on a surface in contact with the casing after hydraulic fracturing.

Hereinafter, specific embodiments of the downhole plug according to the present invention will be described with reference to FIGS. 3 to 11.

Figure 1:
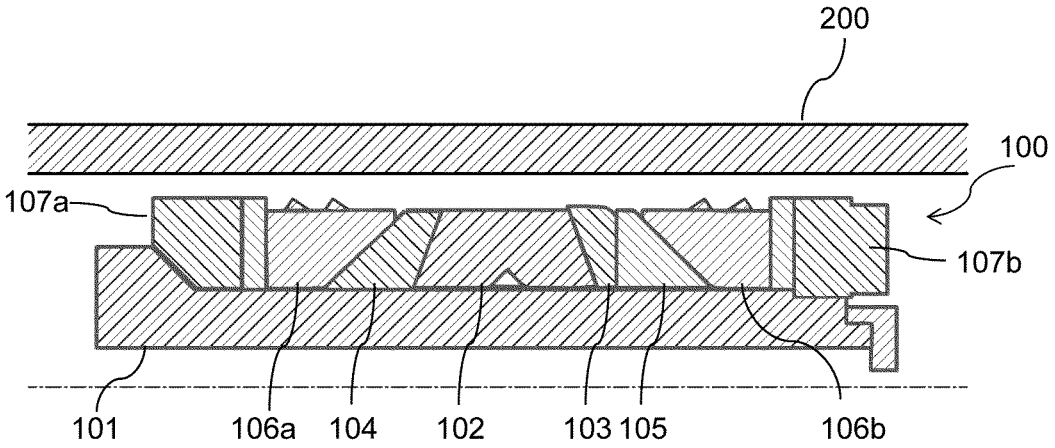
FIG. 1 (PRIOR ART)
FIG. 1 is a view schematically illustrating a portion of an axial cross section of a conventional downhole plug.
Figure 2A:
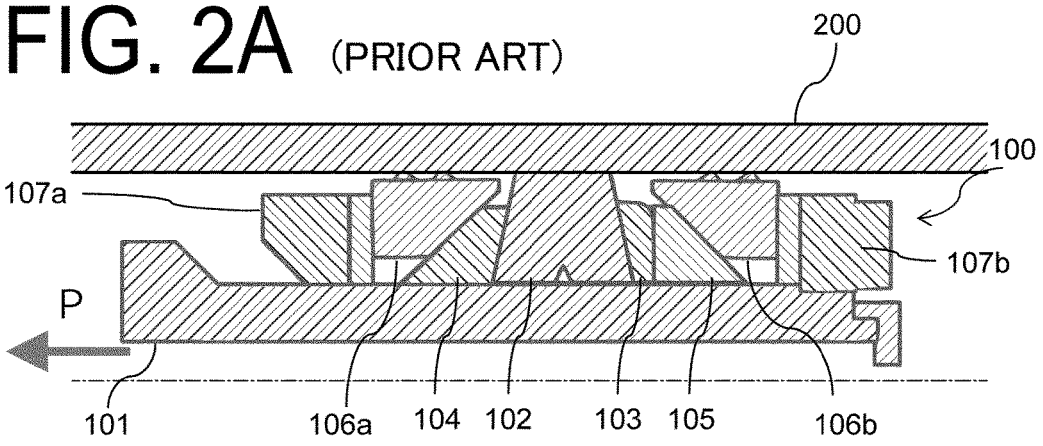
FIG. 2A (PRIOR ART)
FIGS. 2A and 2B includes views of the conventional downhole plug illustrated in FIG. 1 installed and set in a casing, where
Figure 2B:
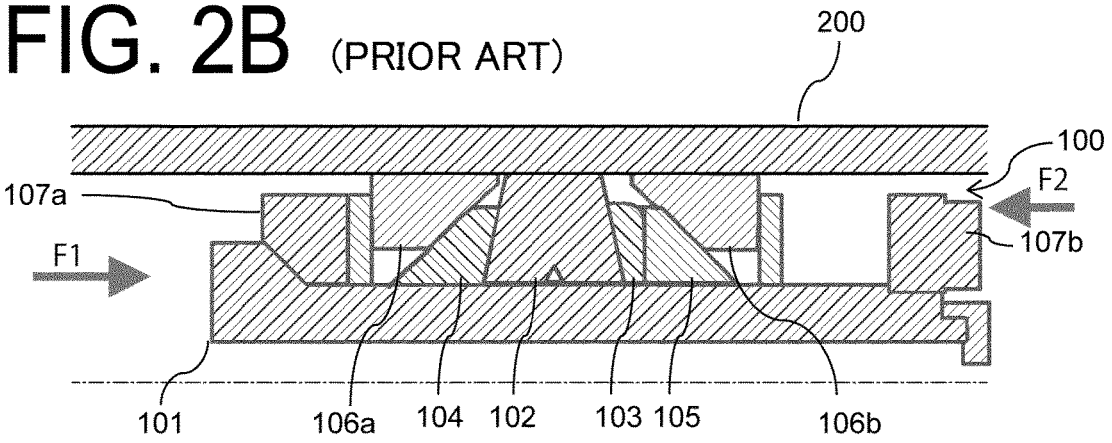
FIG. 2B (PRIOR ART)
Figure 3:
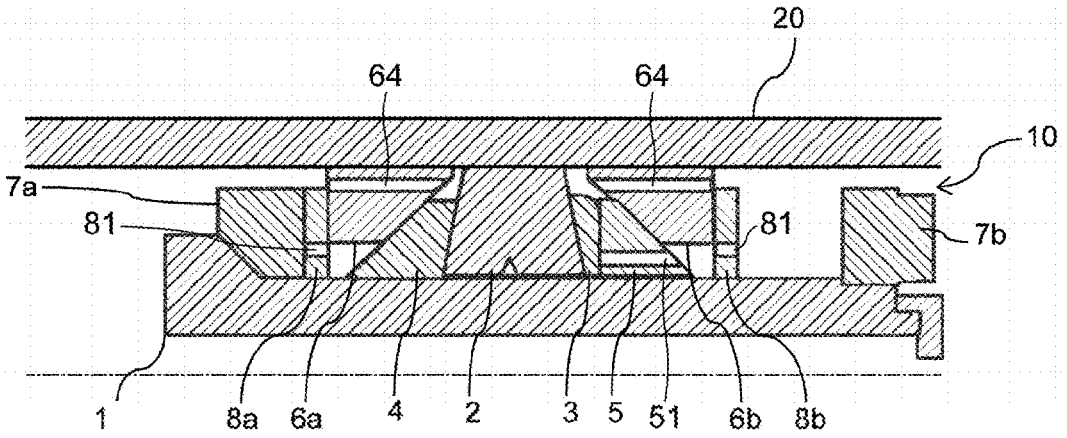
FIG. 3 is a view illustrating a downhole plug according to an embodiment of the present invention set in a casing and subjected to pressure.
Figure 4:
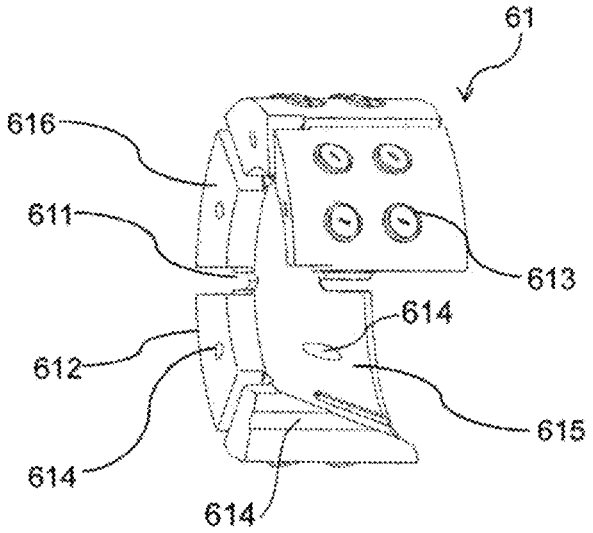
FIG. 4 is a perspective partial cross-sectional view schematically illustrating an aspect of a slip according to an embodiment of the present invention.
Figure 5:
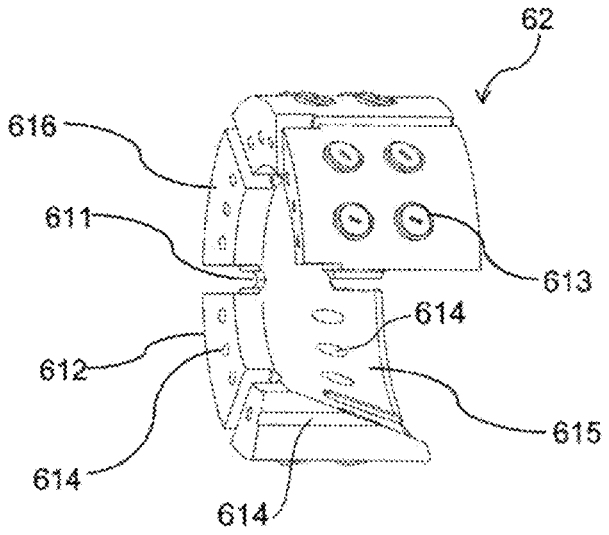
FIG. 5 is a perspective partial cross-sectional view schematically illustrating an aspect of a slip according to an embodiment of the present invention.
Figure 6:
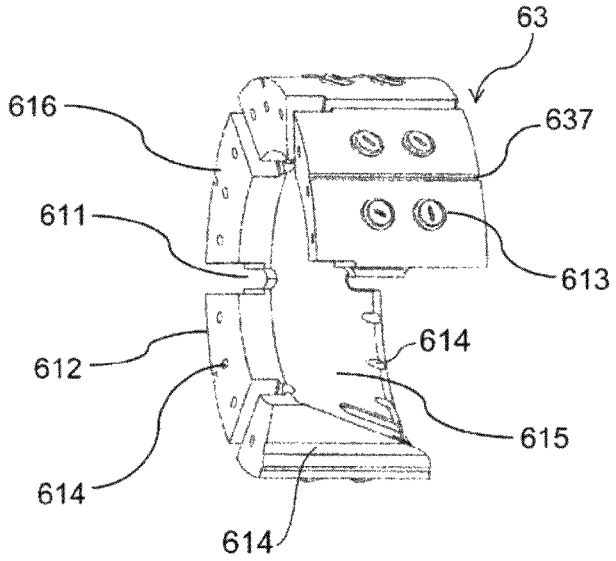
FIG. 6 is a perspective partial cross-sectional view schematically illustrating an aspect of a slip according to an embodiment of the present invention.

FIG. 3 is a diagram schematically illustrating only one of the cross sections symmetrical to the axis in the axial cross section of the mandrel of the downhole plug according to the present embodiment. FIGS. 4 to 6 are perspective partial cross-sectional views schematically illustrating specific aspects of a slip, which is one of the peripheral members of the downhole plug according to the present embodiment. FIGS. 7 to 11 are perspective partial cross-sectional views schematically illustrating specific aspects of a cone, which is one of the peripheral members of the downhole plug according to the present embodiment.

Referring to these figures, the downhole plug 10 is a tool for well completion used to plug a wellbore (not illustrated), and includes a mandrel 1 that is a cylindrical member and peripheral members provided on the outer peripheral surface of the mandrel 1. The peripheral members include a sealing member 2, a socket 3 that is a retaining member, cones 4, 5, a pair of slips 6*a*, 6*b*, a pair of ring members 7*a*, 7*b*, and a pair of outer retaining members 8*a*, 8*b*. Additionally, the socket 3 may be any member, and the socket 3 and the cone 5 may be integrally formed. Also, in FIG. 3, the downhole plug 10 is disposed in the casing 20 disposed within the wellbore.

The mandrel 1 is a member to ensure the strength of the downhole plug 10.

The sealing member 2 is an annular member formed of an elastic material or a rubber material, and is mounted on the outer peripheral surface of the mandrel 1 in the axial direction between the socket 3 and the cone 4. As the mandrel 1 moves in the axial direction and the distance between the cone 4 and the socket 3 is reduced, the sealing member 2 is deformed and expands outwardly in the outer peripheral direction of the axis of the mandrel 1 and contacts the casing 20. Since the inner side of the sealing member 2 is in contact with the outer peripheral surface of the mandrel 1, the space between the downhole plug 10 and the casing 20 is blocked (sealed) by the contact of the sealing member 2 with the casing 20. Next, while the fracturing is performed, the sealing member 2 has the function of maintaining a seal between the downhole plug 10 and the casing 20 by maintaining a state of its contact with the casing 20 and the outer peripheral surface of the mandrel 1. The sealing member 2 is preferably formed of a material which does not lose the function of plugging the wellbore by the sealing member 2 even under the environment of high temperature and high pressure, for example. Preferred materials for forming the sealing member 2 include, for example, nitrile rubber, hydrogenated nitrile rubber, acrylic rubber, and fluororubber. Moreover, as a material for forming the sealing member 2, degradable rubbers such as polyurethane rubber, natural rubber, polyisoprene, acrylic rubber, aliphatic polyester rubber, polyester-based thermoplastic elastomer, and polyamide-based thermoplastic elastomer can be used.

The socket 3 is an annular member, which is attached adjacent to the sealing member 2 and the cone 5 on the outer peripheral surface of the mandrel 1 in the axial direction.

The cones 4, 5 are formed such that when a load or pressure is applied toward the sealing member 2 against a pair of the slips 6*a*, 6*b*, the slips 6*a*, 6*b* slides on the inclined surfaces of the cones 4, 5, respectively.

The slips 6*a*, 6*b* move outwardly orthogonal to the axial direction of the mandrel 1 when a force in the axial direction of the mandrel 1 is applied, and contact the inner wall of the casing 20 to fix the downhole plug 10 to the inner wall of the casing 20. The slips 6*a*, 6*b* may include one or more grooves, convex portions, rough (jagged) surfaces, or the like in the contact portion with the inner wall of the casing 20 in order to further ensure the plugging (sealing) of the space between the downhole plug 10 and the casing 20. Also, the slips 6*a*, 6*b* may be preliminarily divided into a predetermined number in the peripheral direction orthogonal to the axial direction of the mandrel 1. Alternatively, it may not be divided into a predetermined number, but may include a cut that ends midway from one end along the axial direction to the other end. When there is a cut, a force in the axial direction of the mandrel 1 is applied to the cones 4, 5, and the cones 4, 5 enter the inner surface side of the slips 6*a*, 6*b*, so that the slips 6*a*, 6*b* are broken and divided into segments along the cut and its extension line, and then each segment moves outwardly orthogonal to the axial direction of the mandrel 1.

The pair of ring members 7*a*, 7*b* are members placed on the outer peripheral surface orthogonal to the axial direction of the mandrel 1, and are members provided for applying a force in the axial direction of the mandrel 1 to the sealing member 2 capable of expanding in diameter, and the combination of the slips 6*a*, 6*b*, the cones 4, 5, and the socket 3, which are optionally placed as needed.

Also, in the downhole plug 10 illustrated in FIG. 3, a hollow portion 51, a hollow portion 64, and a hollow portion 81 are respectively provided in cone 5, slip 6*a*, 6*b*, and outer retaining member 8*a*, 8*b*, but the peripheral member or combination thereof provided with the hollow portion or the groove is not limited to these.

In the present embodiment, the mandrel 1, the sealing member 2, the socket 3, the cones 4, 5, a pair of the slips 6*a*, 6*b*, and a pair of the ring members 7*a*, 7*b* are each preferably formed of a degradable resin or a degradable metal. This facilitates removal of the downhole plug 10 after the well treatment using the downhole plug 10.

In the present specification, the term "degradable resin or degradable metal" means a resin or metal which can be degraded or embrittled to be easily disintegrated, by biodegradation or hydrolysis, dissolution in water or hydrocarbons in a well, or any chemical method. Examples of the degradable resin include aliphatic polyesters based on hydroxycarboxylic acid such as polylactic acid (PLA) and polyglycolic acid (PGA), lactone-based aliphatic polyesters such as poly-caprolactone (PCL), diol-dicarboxylic acid-based aliphatic polyesters such as polyethylene succinate and polybutylene succinate, copolymers thereof such as glycolic acid-lactic acid copolymers, mixtures thereof, and aliphatic polyesters using in combination aromatic components such as polyethylene adipate/terephthalate, or the like. Furthermore, a water-soluble resin may be used as the degradable resin. Examples of the water-soluble resin include polyvinyl alcohol, polyvinyl butyral, polyvinyl formal, polyacrylamide (which may be N, N-substituted), polyacrylic acid, and polymethacrylic acid, and furthermore copolymers of monomers forming these resins, such as ethylene-vinyl alcohol copolymer (EVOH) and acrylamide-acrylic acid-methacrylic acid interpolymer. Examples of the degradable metal include alloys containing magnesium, aluminum, and calcium as main components.

In one aspect of the present embodiment, the peripheral member provided with the hollow portion or the groove is preferably formed of a surface-degradable material. The surface-degradable material is a material whose weight decreases due to degradation only in surfaces that come into contact with the cause of degradation (such as oxygen and water). In the case of a hydrolyzable material, a material having a high barrier property against water such as a degradable metal and polyglycolic acid corresponds to a surface-degradable material. In the case of a surface-degradable material, the hollow portion or groove expands due to degradation, and therefore, the surface area of the peripheral member increases and accelerates the degradation. On the other hand, in the case of a material that undergoes bulk degradation, the expansion rate of the hollow portion or the groove is slower than a peripheral member formed from a surface-degradable material, the effect of accelerating degradation as much as the surface-degradable material is not obtained.

Hereinafter, an embodiment in which a hollow portion or a groove is provided in the slip or the cone will be described. Additionally, from the viewpoint of accelerating degradation, it is preferable that a hollow portion or a groove is provided in the slips 6*a*, 6*b* or the cones 4, 5 among the peripheral members. In addition, although a hollow portion or a groove may be provided in both slips 6*a*, 6*b* and cones 4, 5, it is preferable to provide only one of the slips and the cones from the viewpoint of strength.

2. Slip with Hollow Portion or Groove

In one aspect of the slips 6*a*, 6*b* in the present embodiment, the slips 6*a*, 6*b* include a hollow portion 64 through which a fluid along the axial direction of the mandrel 1 can pass. The size of the hollow portion 64 is not limited as long as the effect of the present invention can be obtained. However, for example, when the cross section of the hollow portion 64 is circular, in order to ensure the strength of slips 6*a*, 6*b*, it is preferable to be a small diameter, for example, 10 mm or less is preferable, 7 mm or less is more preferable, 6 mm or less is even more preferable, and 5 mm or less is particularly preferable. In addition, since a large hollow portion 64 has a high degradation accelerating effect of slips 6*a*, 6*b*, for example, in the case of a circle, a diameter of 1 mm or greater is preferable, 3 mm or greater is more preferable, and 4 mm or greater is particularly preferable. Moreover, when a metal alloy of magnesium, aluminum or calcium as the main component is used as the degradable material, it is preferable to set the diameter to 3 mm or greater. By setting the diameter to 3 mm or greater, the hollow portion 64 can be prevented from being clogged by degradation by-products (e.g., magnesium hydroxide) resulting from degradation, and the effect by the hollow portion 64 can be reliably obtained.

As used herein, the term "hollow portion 64 through which a fluid along the axial direction of the mandrel 1 can pass" means that a fluid along the axial direction of the mandrel 1 is capable of passing through the hollow portion 64, and is not intended to be limited to a form in which the central axis of the hollow portion 64 coincides with the axial direction of the mandrel 1.

The number of hollow portions 64 is not limited as long as the desired effect can be obtained, but for example, one or more of them is preferable for each piece, two or more are more preferable, and three or more are particularly preferable because of the high degradation accelerating effect. Further, the position of the hollow portion 64 is not limited as long as the desired effect is obtained, but the hollow portion 64 is disposed between the outer surfaces of the slips 6*a*, 6*b* and the inner surfaces of the slips 6*a*, 6*b* that contact the outer peripheral surface of the mandrel or other peripheral member disposed between the outer peripheral surface of the mandrel and the slip. Hollow portion 64 is preferably disposed such that, in a cross section perpendicular to the axial direction of the mandrel 1 of the downhole plug 10, on a straight line passing through the central axis of the mandrel 1 and passing through a point A on the inner periphery and a point B on the outer periphery of slips 6*a*, 6*b*, the maximum value of "slip continuous thickness" indicating the length of a portion other than the hollow portion 64 may be in the range from 91% to 47%, more preferably in the range from 80% to 47%, and particularly preferably in the range from 70% to 47%, of "slip maximum thickness" represented by the maximum length from the point A to the point B. Note that the "slip maximum thickness" may also be represented as a thickness in the radial direction of the slips 6*a*, 6*b* in the cross section. The "slip continuous thickness" may also be represented as the maximum length of the continuous portion in the thickness direction of the slips 6*a*, 6*b*, excluding the hollow portion 64.

In another aspect of the present embodiment, the slips 6*a* and 6*b* include grooves, on the outer surface side thereof, through which a fluid along the axial direction of the mandrel 1 can pass. The size of the groove is not limited as long as the effect of the present invention can be obtained, but for example, a small width of the groove is preferable to ensure strength, for example, 10 mm or less is preferable, 7 mm or less is more preferable, and 5 mm or less is particularly preferable. In addition, also from the viewpoint of ensuring strength, a groove depth of 45% or less of the slip maximum thickness is preferable, 40% or less is more preferable, and 25% or less is particularly preferable. Further, the shape of the groove can be easily machined when it is a straight line from one end to another end of one surface of the slips 6*a*, 6*b*, and when it is a straight line connecting one end to another end of a portion of the surface in contact with the casing 20 after hydraulic fracturing, for example, it is preferable because the length is shorter and the strength is secured while the effect of the present invention is obtained. Since it is easy to introduce the fluid along the axial direction of the mandrel, the ends of the grooves of the slips 6*a*, 6*b* are preferable in a plane perpendicular to the axial direction of the mandrel 1, and particularly preferable in a plane close to the side to which the fluid is supplied.

First Aspect of Slip

A first aspect of the slip 6*a* according to the present embodiment will be described with reference to FIG. 4. The slip 61 illustrated in FIG. 4 is composed of a plurality of slip segments 612 divided by a cut 611 which ends halfway from one end to the other end along the axial direction. Each slip segment 612 includes a plurality of convex portions 613 on its surface in contact with the casing 20 and one hollow portion 614 through which a fluid along the axial direction of the mandrel 1 can pass. After hydraulic fracturing, the surface of the slip 61 in contact with the casing 20 and a contacting portion in a surface 615 in contact with the cone 4 are inhibited from contacting the fluid that promotes degradation, and thus degradation does not proceed. On the other hand, since the other end portion 616 along the axial direction of the mandrel 1 from the surface 615 in contact with the cone 4 is in contact with the fluid, the fluid enters the hollow portion 614 connected to the opening in the surface of the end portion 616, and the fluid contacts the inner wall of the hollow portion 614. In addition, the fluid also enters the cut 611. Therefore, since the slip 61 is degraded from the surface where the cut 611 in contact with the fluid is formed, the end portion 616, and the inner wall of the hollow portion 614, the downhole plug 10 is easily degraded and removed. The slip 6*b* may have the same configuration. This also applies to the other aspects described below.

Second Aspect of Slip

Another aspect of the slip 6*a* according to the present embodiment will be described with reference to FIG. 5. Note that in the present aspect, in order to explain the differences from the first aspect, members having the same function as those of the members described in the aforementioned aspect are denoted by the same member numbers, and descriptions thereof will be omitted.

A slip 62 illustrated in FIG. 5 includes a plurality of hollow portions 614 provided in each slip segment 612. As a result, the area in contact with the fluid increases, and degradation and removal of the downhole plug 10 becomes easier.

Third Aspect of Slip

Another aspect of the slip 6*a* in the present embodiment will be described with reference to FIG. 6. Note that in the present aspect, in order to explain the differences from the first aspect, members having the same function as those of the members described in the aforementioned aspect are denoted by the same member numbers, and descriptions thereof will be omitted.

A slip 63 illustrated in FIG. 6 includes a plurality of hollow portions 614 provided in each slip segment 612. Furthermore, in the slip 63, each slip segment 612 includes a groove 637 along the axial direction of the mandrel 1, located on a surface in contact with the casing 20. Since the fluid also enters this groove 637 and comes into contact with the surface of the groove 637, the degradation proceeds from the surface of the groove 637 as well. As a result, the area in contact with the fluid increases, and degradation and removal of the downhole plug 10 becomes easier.

3. Cone with Hollow Portion or Groove

In one aspect of the cones 4, 5 in the present embodiment, the cones 4, 5 include hollow portions through which the fluid flowing along the axial direction of the mandrel 1 can pass. The size of the hollow portion is not limited as long as the effect of the present invention can be obtained. However, for example, when the cross section of the hollow portion is circular, in order to ensure the strength of cones 4, 5, it is preferable to be a small diameter, for example, 10 mm or less is preferable, 7 mm or less is more preferable, 6 mm or less is even more preferable, and 5 mm or less is particularly preferable. In addition, since the large hollow portion has a high degradation accelerating effect of cones 4, 5, for example, in the case of a hollow portion with circular cross section, a diameter of 1 mm or greater is preferable, 3 mm or greater is more preferable, and 4 mm or greater is particularly preferable. The number of the hollow portions per cone is not limited as long as the desired effect can be obtained, but for example, 4 or more is preferable, 8 or more is more preferable, and 12 or more is particularly preferable because of the high degradation accelerating effect. Further, the position of the hollow portion is not limited as long as the desired effect is obtained, but the hollow portion is disposed between the outer surfaces of the cones 4, 5 and the inner surfaces of the cones 4, 5 that contact the outer peripheral surface of the mandrel 1 or other peripheral member disposed between the mandrel 1 and the cone. Hollow portion is preferably disposed such that, in a cross section perpendicular to the axial direction of the mandrel 1 of the downhole plug 10, on a straight line passing through the central axis of the mandrel 1 and passing through a point A on the inner periphery and a point B on the outer periphery of cones 4, 5, the maximum value of "cone continuous thickness" indicating the length of a portion other than the hollow portion may be in the range from 91% to 47%, more preferably in the range from 80% to 47%, and particularly preferably in the range from 70% to 47%, of "cone maximum thickness" represented by the maximum length from the point A to the point B. Note that the "cone maximum thickness" may also be represented as a thickness in the radial direction of the cones 4, 5 in the cross section. The "cone continuous thickness" may also be represented as the maximum length of the continuous portion in the thickness direction of the cones 4, 5, excluding the hollow portion.

In another aspect of the present embodiment, the cones 4, 5 have grooves on the outer surface side thereof through which a fluid can pass along the axial direction or the peripheral direction of the mandrel 1. The size of the groove is not limited as long as the effect of the present invention can be obtained, but for example, a small width of the groove is preferable to ensure strength, for example, 10 mm or less is preferable, 7 mm or less is more preferable, and 5 mm or less is particularly preferable. In addition, a groove depth of 45% or less of the cone maximum thickness is preferable, 40% or less is more preferable, and 25% or less is particularly preferable.

In still another aspect of the present embodiment, the cones 4, 5 include a groove in its surface that comes into contact with the sealing member 2 or the socket 3. This groove allows the fluid to move in a direction perpendicular to the axis of the downhole plug 10. As for the shape and arrangement of the grooves in the cones 4, 5, it is preferable that the grooves in the cones 4, 5 are on a straight line from the central axis of the mandrel 1 through the outer periphery of the cones 4, 5 in a cross section orthogonal to the axis of the downhole plug 10, and that a plurality of the grooves are arranged radially. The size of the groove is not limited as long as the desired effect of the present invention can be obtained, but for example, a small width of the groove is preferable to ensure strength, for example, 10 mm or less is preferable, 7 mm or less is more preferable, and 5 mm or less is especially preferable. In addition, a groove depth of 45% or less of the cone maximum thickness is preferable, 40% or less is more preferable, and 25% or less is particularly preferable.

First Aspect of Cone

Figure 7:
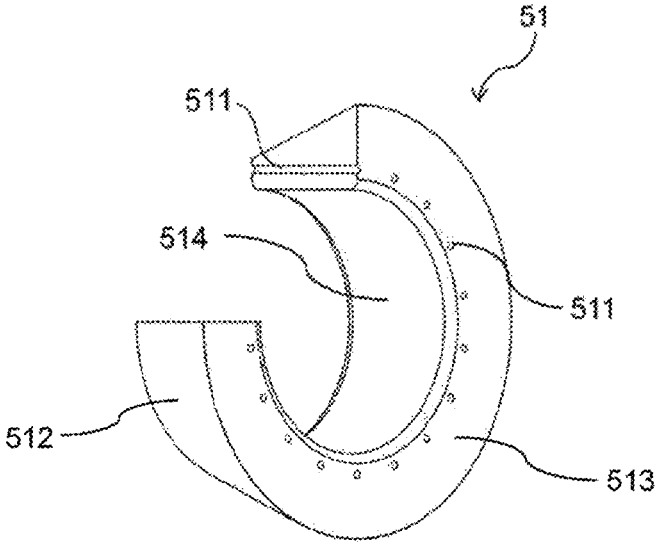
FIG. 7 is a perspective partial cross-sectional view schematically illustrating an aspect of a cone according to an embodiment of the present invention.

A first aspect of the cone 5 according to the present embodiment will be described with reference to FIG. 7. A cone 51 illustrated in FIG. 7 includes a plurality of hollow portions 511 through which a fluid along the axial direction of the mandrel 1 can pass. After hydraulic fracturing, the fluid does not contact the portion, of a surface 512 of the cone 51, that partially contacts the slip 6*b*, a surface 513 that contacts the socket 3, and a surface 514 that contacts the mandrel 1. The hollow portion 511 is connected to an opening at the other end along the axial direction of the mandrel 1 from the surface 513 in contact with the socket 3. Therefore, it is easy to degrade and remove the downhole plug 10 because the fluid enters through the opening and comes into contact with the inner wall of the hollow portion 511.

Second Aspect of Cone

Another aspect of the cone 5 according to the present embodiment will be described with reference to FIG. 8. Note that in the present aspect, in order to explain the differences from the first aspect, members having the same function as those of the members described in the aforementioned aspect are denoted by the same member numbers, and descriptions thereof will be omitted.

Figure 8:
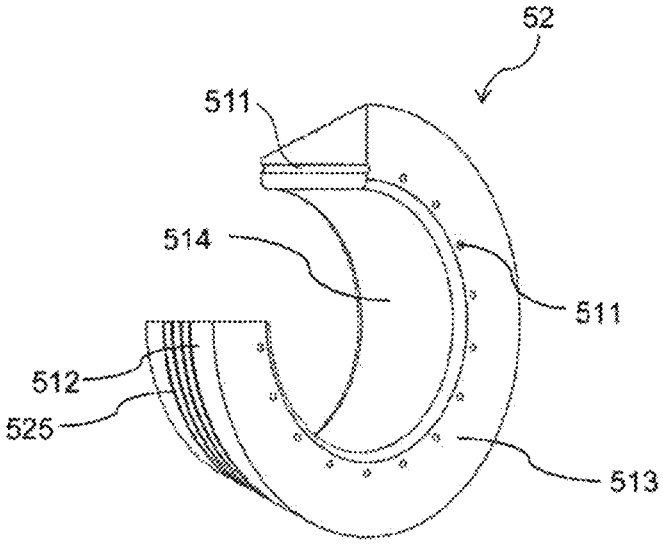
FIG. 8 is a perspective partial cross-sectional view schematically illustrating an aspect of a cone according to an embodiment of the present invention.

A cone 52 illustrated in FIG. 8 further includes a groove 525 along the peripheral direction of the surface 512 that is partially in contact with the slip 6*b*. Therefore, after hydraulic fracturing, a gap is created between the slip 6*b* and the cone 52 due to the groove 525, and the fluid in the cut portion of the slip 6*b* enters the gap. Therefore, since the cone 52 starts to degrade from the gap formed by the inner wall of the hollow portion 511 and the groove 525, which contact the fluid, the downhole plug 10 is easily degraded and removed.

Third Aspect of Cone

Figure 9:
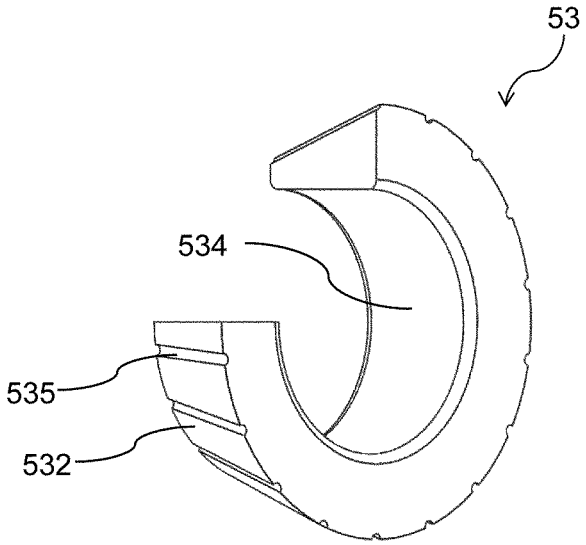
FIG. 9 is a perspective partial cross-sectional view schematically illustrating an aspect of a cone according to an embodiment of the present invention.

Another aspect of the cone 5 according to the present embodiment will be described with reference to FIG. 9. A cone 53 illustrated in FIG. 9 includes a groove 535 along the axial direction of the mandrel 1, located on a surface 532 that is partially in contact with the slip 6*b*. After the hydraulic fracturing, a gap along the axial direction of the mandrel 1 is formed between the slip 6*b* and the cone 53 due to the groove 535, and the fluid enters the gap. Therefore, since the cone 53 starts to degrade from the gap formed by the groove 535 in contact with the fluid, the downhole plug 10 is easily degraded and removed.

Fourth Aspect of Cone

Another aspect of the cone 5 according to the present embodiment will be described with reference to FIG. 10. Note that in the present aspect, in order to explain the differences from the first aspect, members having the same function as those of the members described in the aforementioned aspect are denoted by the same member numbers, and descriptions thereof will be omitted.

Figure 10:
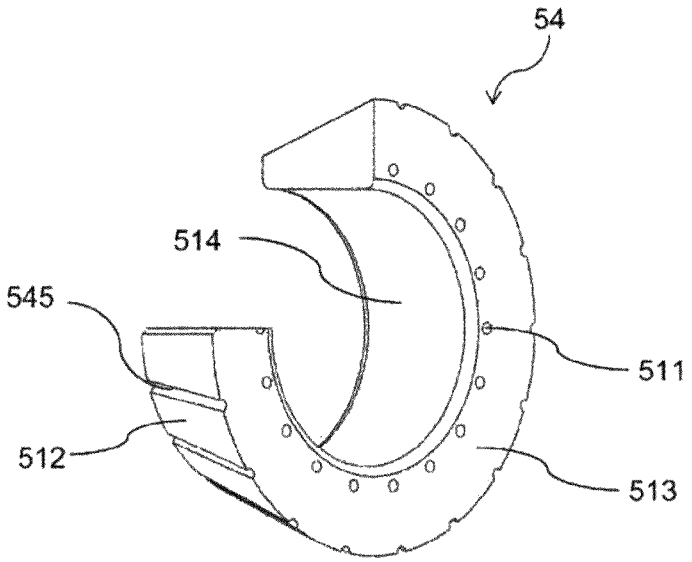
FIG. 10 is a perspective partial cross-sectional view schematically illustrating an aspect of a cone according to an embodiment of the present invention.

A cone 54 illustrated in FIG. 10 further includes a groove 545 along the axial direction of the mandrel 1, located on a surface 512 that is partially in contact with the slip 6*b*. After hydraulic fracturing, a gap is created between the slip 6*b* and the cone 54 due to the groove 545, and the fluid enters the gap. Therefore, since the cone 54 starts to degrade from the gap formed by the inner wall of the hollow portion 511 and the groove 545, which contact the fluid, the downhole plug 10 is easily degraded and removed.

Fifth Aspect of Cone

Another aspect of the cone according to the present embodiment will be described with reference to FIG. 11. Note that in the present aspect, in order to explain the differences from the first aspect, members having the same function as those of the members described in the aforementioned aspect are denoted by the same member numbers, and descriptions thereof will be omitted.

Figure 11:
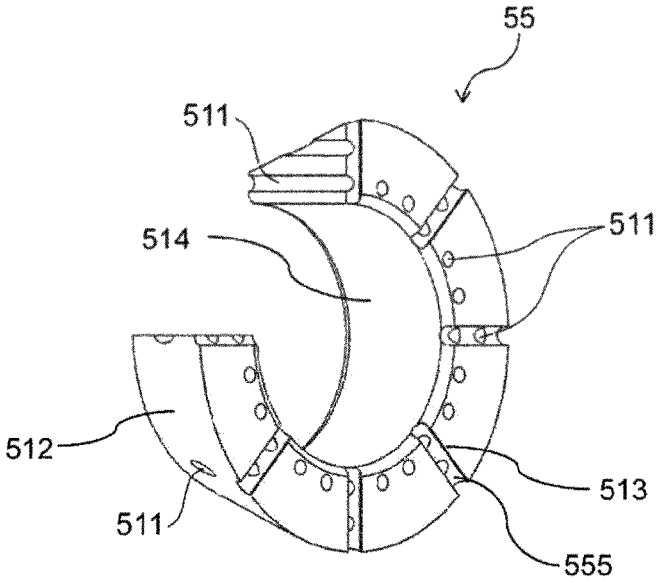
FIG. 11 is a perspective partial cross-sectional view schematically illustrating an aspect of a cone according to an embodiment of the present invention.

A cone 55 illustrated in FIG. 11 further includes a groove 555, through which a fluid can pass and which is radially arranged from the center axis of the mandrel 1 toward the outer surface of the cone 55 on the surface 513 that contacts the socket 3. Furthermore, compared to the hollow portion 511 in the cone 51 of the first aspect, the hollow portion 511 in FIG. 11 is also provided in a position further away from the mandrel 1. After hydraulic fracturing, the entered fluid flows through the groove 555, which is provided on the surface 513 in contact with the socket 3 and extends from the central axis of the mandrel 1 towards the outer surface of the cone 55. Therefore, since the cone 55 starts to degrade from the gap formed by the inner wall of the hollow portion 511 and the groove 555, which contact the fluid, the downhole plug 10 is easily degraded and removed.

4. Method for Manufacturing Downhole Plug

The downhole plug 10 of the present embodiment is manufactured by using and assembling the mandrel 1 and the peripheral members with a known method. Mandrel 1 can be manufactured by a known method depending on its material. Furthermore, as the method for manufacturing the peripheral members, a known method can be selected in accordance with the material of the peripheral members, and is typically manufactured by molding a substrate, and then creating a hole or groove by cutting and drilling or the like.

SUMMARY

As described above, the downhole plug of the present embodiment includes: a mandrel made of a degradable material; and a plurality of peripheral members made of a degradable material and provided on an outer peripheral surface of the mandrel, where at least one of the plurality of peripheral members includes: a hollow portion through which a fluid flowing along an axial direction of the mandrel can pass; or a groove in at least a portion of, a surface serving as an outer surface of the downhole plug, or a surface in contact with the mandrel.

Additionally, in one aspect of the downhole plug of the present embodiment, the hollow portion is connected to at least one opening in a surface of the peripheral member provided with the hollow portion.

Additionally, in one aspect of the downhole plug of the present embodiment, the opening is present on the outer surface side of the downhole plug after setting of the downhole plug.

Additionally, in one aspect of the downhole plug of the present embodiment, the hollow portion is a through hole.

Additionally, in one aspect of the downhole plug of the present embodiment, the hollow portion has a circular cross section.

Additionally, in one aspect of the downhole plug of the present embodiment, the peripheral member also has at least one opening in a surface in contact with the mandrel, and the hollow portion is connected to the opening in the surface in contact with the mandrel.

Additionally, in one aspect of the downhole plug of the present embodiment, the peripheral member also has at least one groove in a surface in contact with the mandrel.

Additionally, in one aspect of the downhole plug of the present embodiment, the at least one of peripheral members is a slip or a cone.

Additionally, in one aspect of the downhole plug of the present embodiment, the at least one of peripheral members has the hollow portion, and in a cross section that is perpendicular to the axial direction of the mandrel and that includes the hollow portion, a maximum length of a continuous portion in the thickness direction of the peripheral member excluding the hollow portion with respect to a thickness in a radial direction of the peripheral member is from 47% to 91%.

In addition, it is represented that one aspect of the downhole plug of the present embodiment is configured such that the downhole plug includes a mandrel and a peripheral member provided on an outer peripheral surface of the mandrel, where the peripheral member is made of a degradable material, and a ratio of a continuous thickness maximum value of the peripheral member to a maximum thickness is from 47% to 91%.

INDUSTRIAL APPLICABILITY

The present invention has industrial applicability because it provides a degradable downhole tool for use in hydraulic fracturing, which is a method for completion of shale gas and oil wellbore.

REFERENCE SIGNS LIST

1 Mandrel
2 Sealing member (peripheral member)
3 Socket (peripheral member)
4, 5, 51, 52, 53, 54, 55 Cone (peripheral member)
6*a*, 6*b*, 61, 62, 63 Slip (peripheral member)
7*a*, 7*b* Ring member
8*a*, 8*b* Outer retaining member (peripheral member)
10 Downhole plug

20 Casing
64 Hollow portion
100 Conventional downhole plug
101 Mandrel
102 Sealing member
103 Retaining member
104, 105 Conventional cone
106*a*, 106*b* Conventional slip
200 Casing
511, 614 Hollow portion
525, 535, 545, 637 Groove

The invention claimed is:

1. A downhole plug, comprising:

a mandrel made of a degradable material; and a plurality of peripheral members made of a degradable material and provided on an outer peripheral surface of the mandrel, wherein at least one of the plurality of peripheral members includes a hollow portion, wherein the hollow portion is a through hole, and wherein the hollow portion is configured to pass a fluid flowing along an axial direction of the mandrel through the peripheral member provided with the hollow portion, and that the fluid degrades the degradable material of a wall defining the hollow portion of the peripheral member, wherein the peripheral member provided with the hollow portion is a cone, and wherein the cone has a groove in a portion of a surface in contact with a slip.

2. The downhole plug according to claim 1, wherein an opening is present on the surface of the peripheral member provided with the hollow portion of the downhole plug after setting of the downhole plug.

3. The downhole plug according to claim 1, wherein the hollow portion has a circular cross section.

4. The downhole plug according to claim 3, wherein a diameter of the hollow portion is 1 mm or more and 10 mm or less.

5. The downhole plug according to claim 4, wherein the degradable material of the peripheral member provided with the hollow portion is a metal alloy which contains magnesium, aluminum or calcium as a main component, and the diameter of the hollow portion is 3 mm or more.

6. The downhole plug according to claim 1, wherein the at least one of peripheral members is a slip or a cone.

7. The downhole plug according to claim 1, wherein the at least one of peripheral members has the hollow portion, and the hollow portion is positioned in a cross section that is perpendicular to the axial direction of the mandrel, such that a maximum length of a continuous portion with respect to a thickness in a radial direction of the peripheral member is from 47% to 91%.

8. The downhole plug according to claim 1, wherein the peripheral member provided with the hollow portion is a slip, and wherein the downhole plug further comprises a cone made of a degradable material and has a face contacting with the slip, wherein the face has a groove extending to a peripheral direction of the mandrel.

9. A downhole plug, comprising:

a mandrel made of a degradable material; and a plurality of peripheral members made of a degradable material and provided on an outer peripheral surface of the mandrel, wherein at least one of the plurality of peripheral members includes a hollow portion, wherein the hollow portion is a through hole, and wherein the hollow portion is configured to pass a fluid flowing along an axial direction of the mandrel through the peripheral member provided with the hollow portion, and that the fluid degrades the degradable material of a wall defining the hollow portion of the peripheral member, wherein the peripheral member provided with the hollow portion is a cone, and wherein the cone has a groove radially extending along a direction from an axis of the mandrel to the outer peripheral of the cone.

10. The downhole plug according to claim 9, wherein an opening is present on the surface of the peripheral member provided with the hollow portion of the downhole plug after setting of the downhole plug.

11. The downhole plug according to claim 9, wherein the hollow portion has a circular cross section.

12. The downhole plug according to claim 11, wherein a diameter of the hollow portion is 1 mm or more and 10 mm or less.

13. The downhole plug according to claim 12, wherein the degradable material of the peripheral member provided with the hollow portion is a metal alloy which contains magnesium, aluminum or calcium as a main component, and the diameter of the hollow portion is 3 mm or more.

14. The downhole plug according to claim 9, wherein the at least one of peripheral members is a slip or a cone.

15. The downhole plug according to claim 9, wherein the at least one of peripheral members has the hollow portion, and the hollow portion is positioned in a cross section that is perpendicular to the axial direction of the mandrel, such that a maximum length of a continuous portion with respect to a thickness in a radial direction of the peripheral member is from 47% to 91%.

* * * * *